US008382437B2

(12) United States Patent
Tao et al.

(10) Patent No.: US 8,382,437 B2
(45) Date of Patent: Feb. 26, 2013

(54) FAN STRUCTURE

(75) Inventors: Bin Tao, Sinjhuang (TW); Chiang-Han Chen, Sinjhuang (TW)

(73) Assignee: Asia Vital Components Co., Ltd., Sinjhuang, Taipei County (TW)

( * ) Notice: Subject to any disclaimer, the term of this patent is extended or adjusted under 35 U.S.C. 154(b) by 786 days.

(21) Appl. No.: 12/551,552

(22) Filed: Aug. 31, 2009

(65) Prior Publication Data

US 2011/0052396 A1 Mar. 3, 2011

(51) Int. Cl.
*B64C 11/04* (2006.01)
*F03B 3/12* (2006.01)
*F04D 29/34* (2006.01)

(52) U.S. Cl. ..... 416/212 R; 416/204 R

(58) Field of Classification Search ..... 416/1, 5, 416/175, 183, 200 R, 204 R, 207–209, 212 R
See application file for complete search history.

(56) References Cited

U.S. PATENT DOCUMENTS

| | | | | |
|---|---|---|---|---|
| 6,059,531 | A * | 5/2000 | Tai | 416/220 A |
| 7,201,565 | B2 * | 4/2007 | Ku et al. | 416/175 |
| 7,399,159 | B2 * | 7/2008 | Matheny et al. | 416/62 |
| 2009/0155080 | A1 * | 6/2009 | Yu | 416/212 R |

* cited by examiner

*Primary Examiner* — Edward Look
*Assistant Examiner* — Woody A Lee, Jr.

(57) ABSTRACT

A fan structure including a hub and at least one blade. The hub includes a top section, an annular section and at least one first connection section. The first connection section is selectively disposed on the top section or the annular section. One end of the annular section is connected with a circumference of the top section to define a receiving space. The blade has at least one second connection section disposed at one end of the blade. The second connection section is complementary to the first connection section and connected thereto. The blades are positioned in an overlapping pattern. The blades are independently formed and are easier to manufacture. Therefore, the manufacturing process of the fan structure is simplified and the manufacturing cost is lowered. Moreover, the wind power of the fan structure is increased.

4 Claims, 12 Drawing Sheets

FAN STRUCTURE

FIELD OF THE INVENTION

The present invention relates to an improved fan structure including a hub and at least one blade assembled therewith. The blades are independently formed and are easier to manufacture. Therefore, the manufacturing process of the fan structure is simplified and the manufacturing cost is lowered. Moreover, the wind power of the fan structure is increased.

BACKGROUND OF THE INVENTION

Following the development of electronic industries, the performances of all kinds of electronic components have been rapidly promoted to have faster and faster processing speed. Also, an electronic component contains more and more chips therein. The chips work at high speed and generate high heat at the same time. The heat must be efficiently dissipated outward. Otherwise, the performances of the electronic component will be greatly affected to slow down the operation speed of the electronic component. In some serious cases, the electronic component may be burnt out due to overheating. Therefore, heat dissipation has become a critical topic for all kinds of electronic components. A cooling fan is often used as a heat dissipation device for electronic components.

The conventional cooling fans can be divided into plastic-made fans and metal-made fans. In practice, the plastic-made cooling fans have lower durability than the metal-made cooling fans. For example, the blades of a plastic fan are subject to damage due to collision or compression. Therefore, metal cooling fans have been more and more widely developed by manufacturers.

FIGS. 1A and 1B are perspective exploded and perspective assembled views of a conventional metal-made cooling fan. The cooling fan includes a hub 10 and a blade assembly 12 having multiple blades 121 and a connection member 122. The blades 121 extend from a circumference of the connection member 122 to form the blade assembly 12. The blade assembly 12 is capped on the hub 10 with the connection member 122 and the blades 121 attaching to the top face and outer circumference of the hub 10 respectively. The blades 121 and the connection member 122 are fixedly point-welded on the top face and the outer circumference of the hub 10 respectively to form the cooling fan.

The above metal-made cooling fan is free from the problem of poor durability and is not so easy to damage as the plastic cooling fan. However, the metal-made cooling fan has otherwise problems. The blade assembly 12 is made with a press mold (not shown). The connection member 122 is first made by means of pressing. Then the blades 121 are continuously formed by means of pressing. When pressing the blade assembly 12, intervals must be reserved between the blades 121 for pressing the blades 121. Due to the reserved intervals, it is impossible to press the blades in an overlapping pattern. As a result, the wind power of the cooling fan is unsatisfying. Moreover, the pressing process of the blade assembly 12 is complicated so that it is difficult to form the blade assembly 12 with the press mold. In comparison with a common mold for pressing one single blade at a time, the cost for the press mold is much higher.

Also, when assembling the blade assembly 12 with the hub 10, the blade assembly 12 is capped onto the hub 10 with the connection member 122 and the blades 121 attaching to the top face and the outer circumference of the hub 10 respectively. Thereafter, the blades 121 and the connection member 122 are point-welded on the top face and the outer circumference of the hub 10. However, when point-welded, the blade assembly 12 is simply attached to the hub 10 without being located thereon. Therefore, during the point-welding process, the blade assembly 12 and the hub 10 tend to displace from each other. As a result, the blades 121 can hardly be fixed in their true positions. In this case, the blades 121 will produce turbulent airflow to cause wind resistance. Consequently, the wind power of the cooling fan will be deteriorated.

According to the aforesaid, the conventional cooling fan has the following shortcomings:

1. The manufacturing cost for the conventional cooling fan is high.
2. The wind power of the conventional cooling fan is low.
3. It is hard to manufacture the conventional cooling fan.

SUMMARY OF THE INVENTION

A primary object of the present invention is to provide an improved fan structure, which is manufactured at lower cost.

A further object of the present invention is to provide the above fan structure the manufacturing process of which is simplified.

A still further object of the present invention is to provide the above fan structure, which can generate higher wind power.

To achieve the above and other objects, the fan structure of the present invention includes a hub and at least one blade. The hub includes a top section, an annular section and at least one first connection section. The first connection section is selectively disposed on the top section or the annular section. One end of the annular section is connected with a circumference of the top section to define a receiving space. The blade has at least one second connection section disposed at one end of the blade. The second connection section is complementary to the first connection section and connected thereto. The blades are positioned in an overlapping pattern. The blades are independently formed and are easier to manufacture. Therefore, the manufacturing process of the fan structure is simplified and the manufacturing cost is lowered. Moreover, the wind power of the fan structure is increased.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
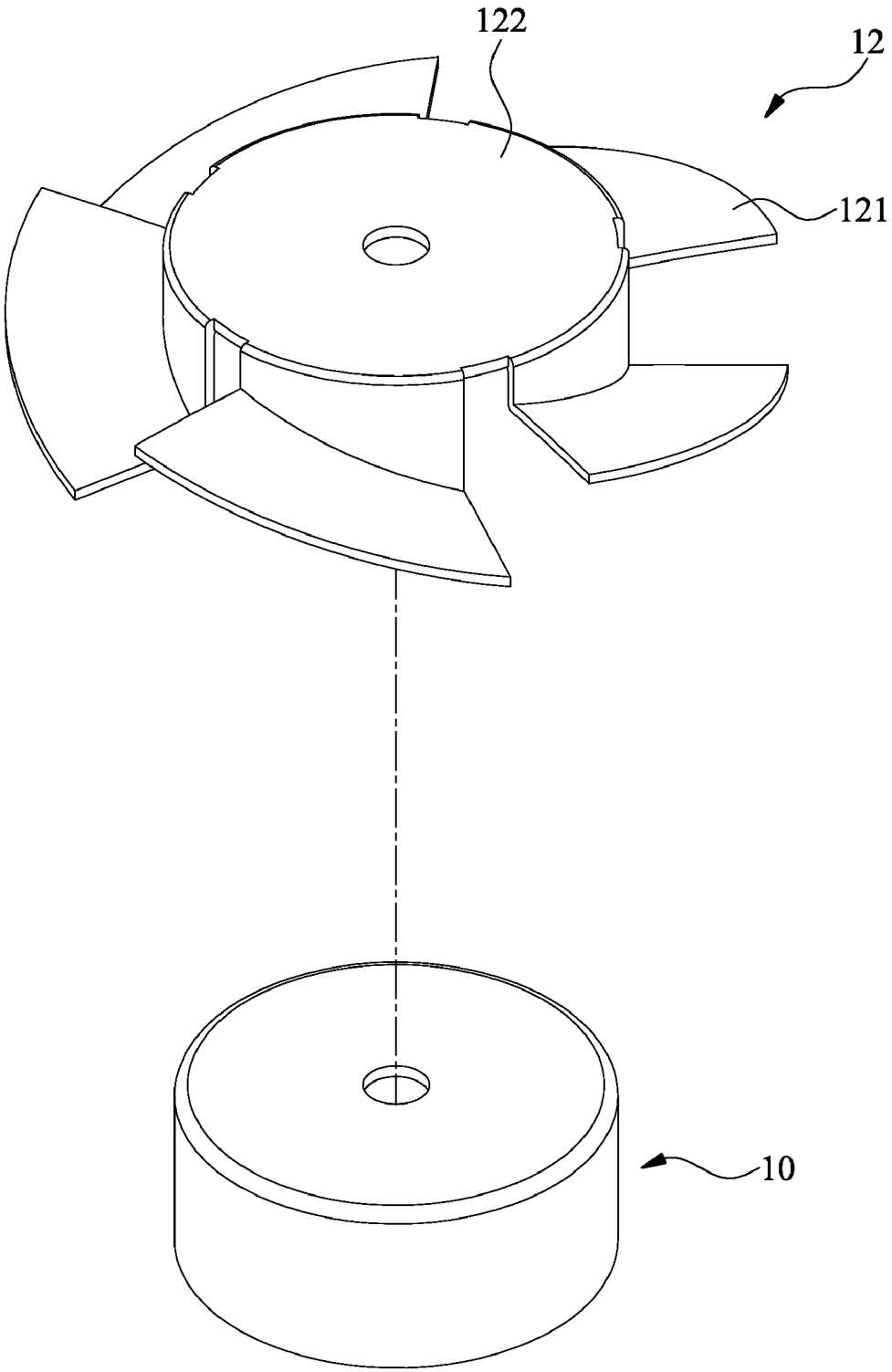
FIG. 1A (PRIOR ART)
FIG. 1A is a perspective exploded view of a conventional fan.
Figure 1B:
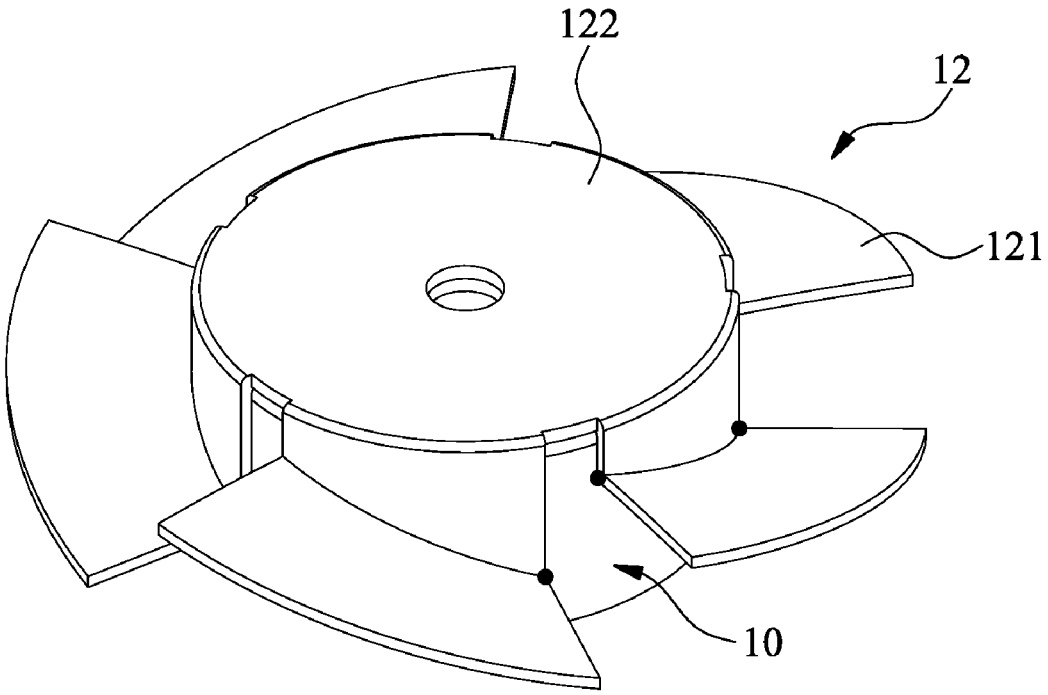
FIG. 1B (PRIOR ART)
FIG. 1B is a perspective assembled view of the conventional fan.

Please refer to FIGS. 2 to 6. According to a first embodiment, the fan structure of the present invention includes a hub 2 and at least one blade 3. The hub 2 includes a top section 21, at least one first connection section 23 and an annular section 22. The first connection section 23 is selectively disposed on the top section 21 or the annular section 22. In a first aspect of this embodiment, the first connection section 23 is disposed on the annular section 22. In a second aspect of this embodiment, the first connection section 23 is disposed on the top section 21.

Figure 2:
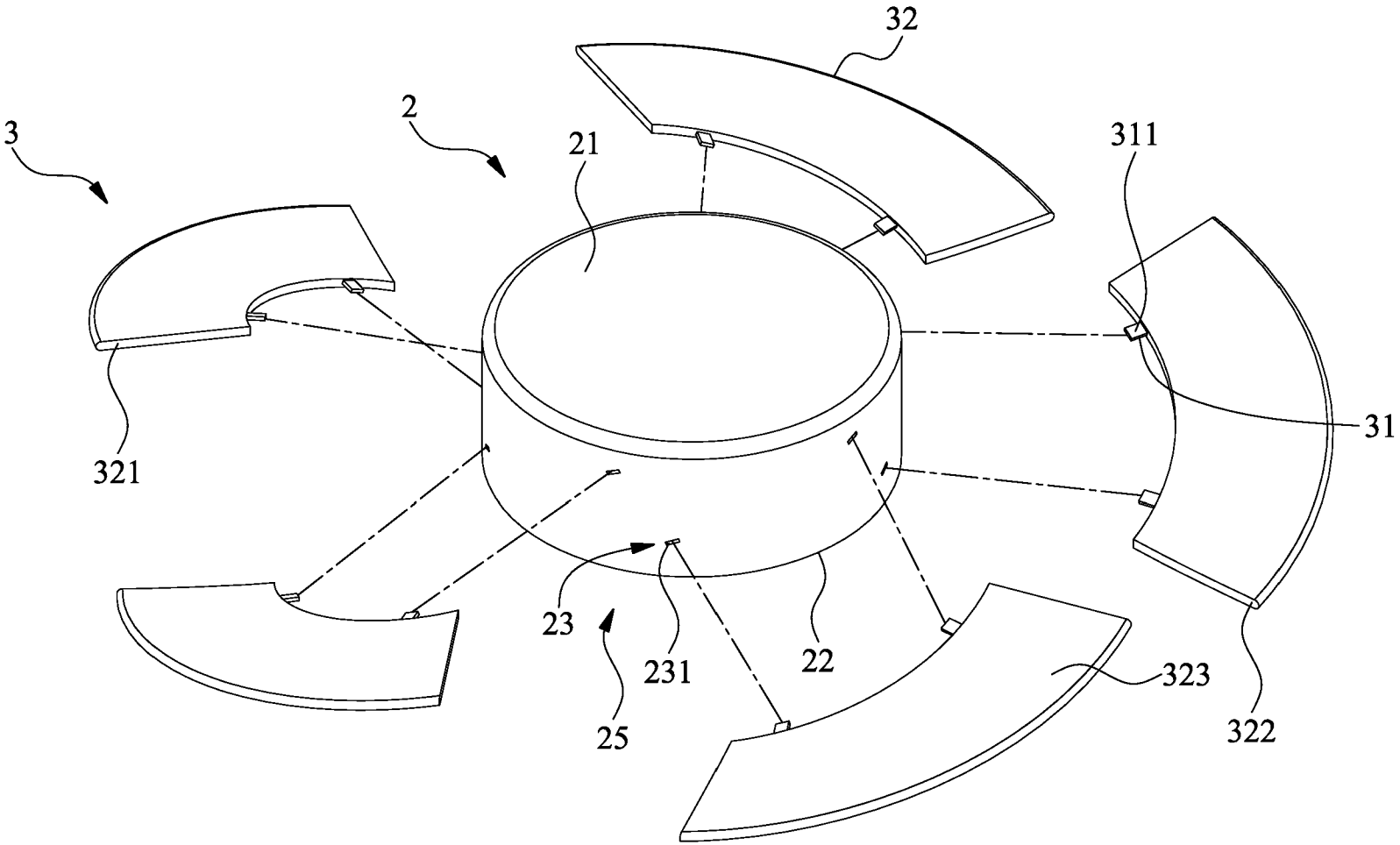
FIG. 2 is a perspective exploded view of a first aspect of a first embodiment of the present invention.
Figure 3:
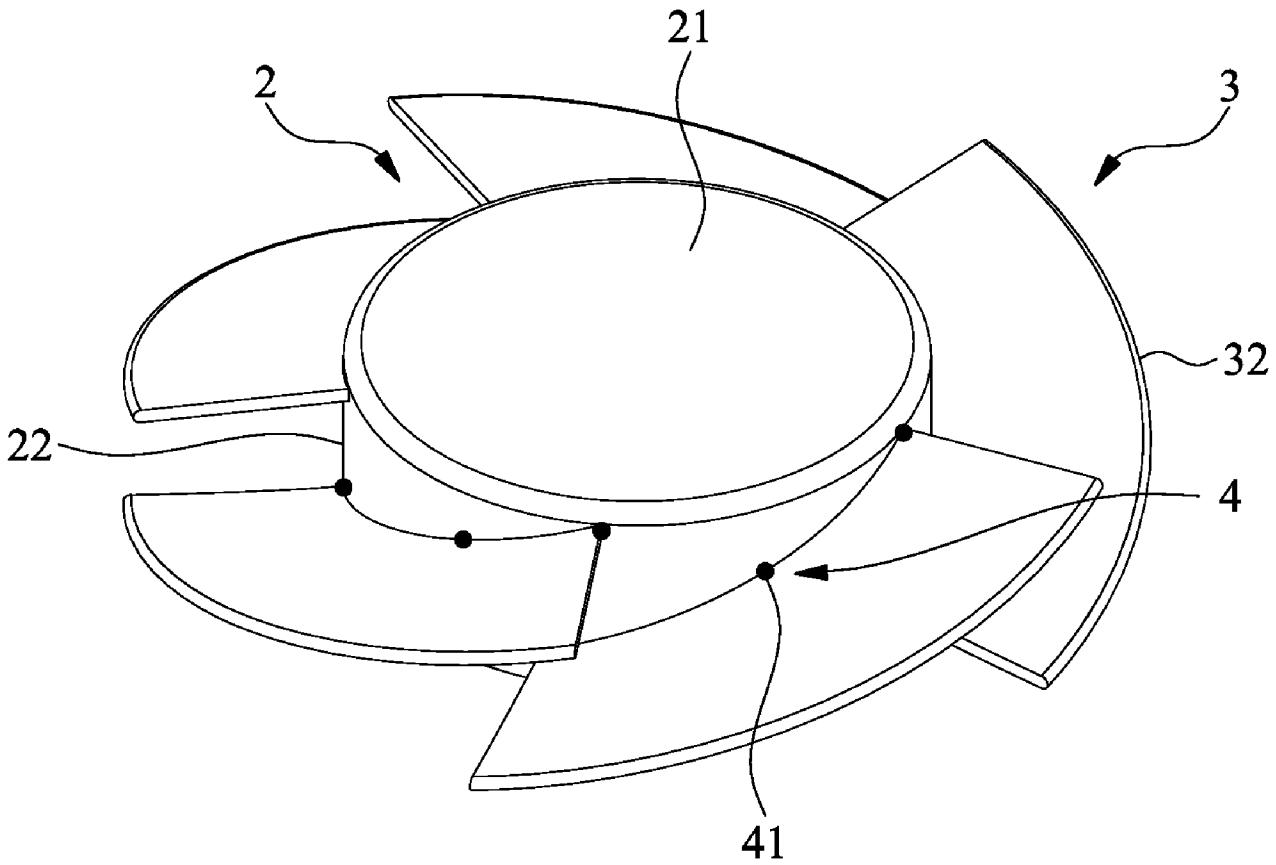
FIG. 3 is a perspective assembled view of the first aspect of the first embodiment of the present invention.

Please refer to FIGS. 2 and 3, which show the first aspect. The first connection sections 23 are annularly arranged on a circumference of the annular section 22. Each two adjacent first connection sections 23 are positioned at different heights. The annular section 22 is perpendicularly connected with a circumference of the top section 21. That is, one end of the annular section 22 is connected with the circumference of the top section 21, whereby the annular section 22 and the top section 21 together define a receiving space 25 in which a shaft seat of a frame body (not shown) is enclosed. The hub 2 and the blades 3 are made of metal material such as iron, aluminum or copper or a metal alloy.

Each blade 3 has at least one second connection section 31 and a wind guide section 32. The second connection section 31 is disposed at one end of the blade 3. The second connection section 31 is complementary to the first connection section 23 and connected thereto, whereby the blade 3 is integrally connected with the hub 2. In other words, the second connection section 31 of the blade 3 is fixedly engaged with (or insert-connected with) the first connection section 23 of the annular section 22 to integrally connect the blade 3 with the hub 2. In addition, the blades 3 can be positioned at different heights in an overlapping pattern. Under such circumstance, the fan can more efficiently operate to greatly enhance wind power. The second connection section 31 can be connected to the complementary first connection section 23 by way of engagement, insertion, tight fit or the like.

The wind guide section 32 has a front edge 321, a rear edge 322 and a wind guide face 323. One side of the wind guide face 323 between the front edge 321 and rear edge 322 is connected with the second connection section 31. The wind guide faces 323 of each two adjacent wind guide sections 32 are positioned at different heights in an overlapping pattern. The wind guide section 32 and the second connection section 31 are integrally formed.

Please further refer to FIGS. 2 and 3. The fan structure further includes a welding section 4 having at least one welding point 41 welded in a position near a conjunction between the first connection section 23 and the second connection section 31. To speak more specifically, after the first connection section 23 of the hub 2 is fixedly engaged with (or insert-connected with) the second connection section 31 of the blade 3, one side of the wind guide face 323 of the wind guide section 32 is tightly attached to and leant against the circumference of the annular section 22. Then the welding point 41 of the welding section 4 is fixedly point-welded in the position near the conjunction between the first connection section 23 and the second connection section 31. The welding point 41 serves to enhance connection strength between the blade 3 and the hub 2.

The first connection section 23 has a locating hole 231, which is disposed on the outer circumference of the annular section 22 at an inclination in communication with the receiving space 25. The second connection section 31 has a projection 311 outward extending from one side of the wind guide face 323 corresponding to the locating hole 231. When assembled, the projection 311 is fitted through the locating hole 231 to protrude into the receiving space 25 so as to fixedly connect the blade 3 with the hub 2.

Accordingly, when connecting the blade 3 with the hub 2, the blade 3 is forced toward the hub 2 to fit the projection 311 of the second connection section 31 of the blade 3 into the locating hole 231 of the first connection section 23 and protrude the projection 311 into the receiving space 25. In this case, the projection 311 is fixedly engaged in the locating hole 231. At this time, one side of the wind guide face 323 of the wind guide section 32 snugly tightly attaches to the circumference of the annular section 22. The wind guide faces 323 of the adjacent wind guide sections 32 are positioned in an overlapping pattern. Then the welding point 41 of the welding section 4 is fixedly welded in the position near the conjunction between the first connection section 23 and the second connection section 31 so as to enhance the connection strength between the blade 3 and the hub 2. In this case, the structural strength of the fan is enhanced as a whole and the wind power of the fan is greatly promoted.

Moreover, the blades 3 are independently formed by means of pressing. In comparison with the complicated and difficult manufacturing process of the conventional blades, the blades 3 of the present invention are easier to manufacture so that the manufacturing cost is lowered.

Figure 4:
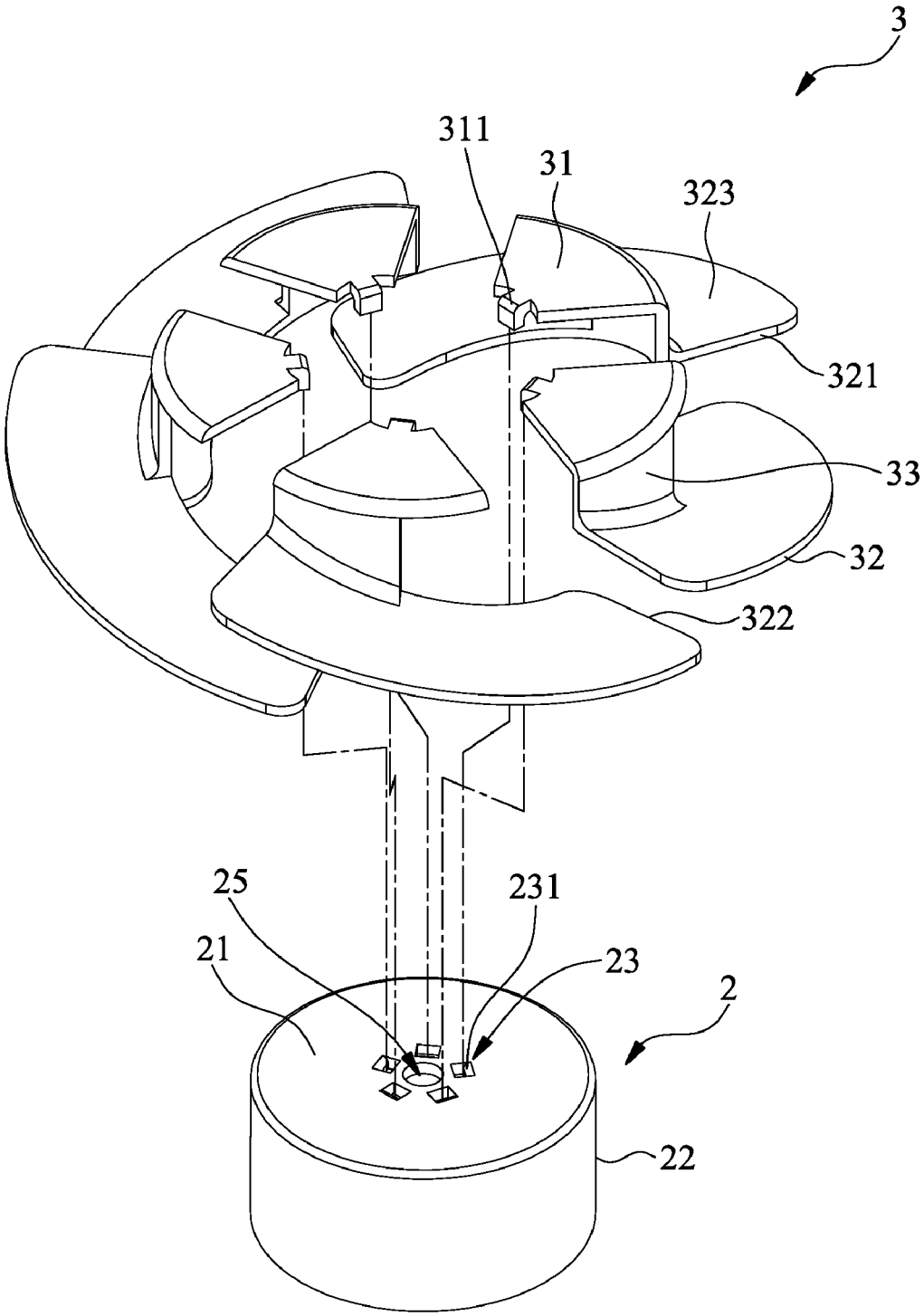
FIG. 4 is a perspective exploded view of a second aspect of the first embodiment of the present invention.
Figure 5:
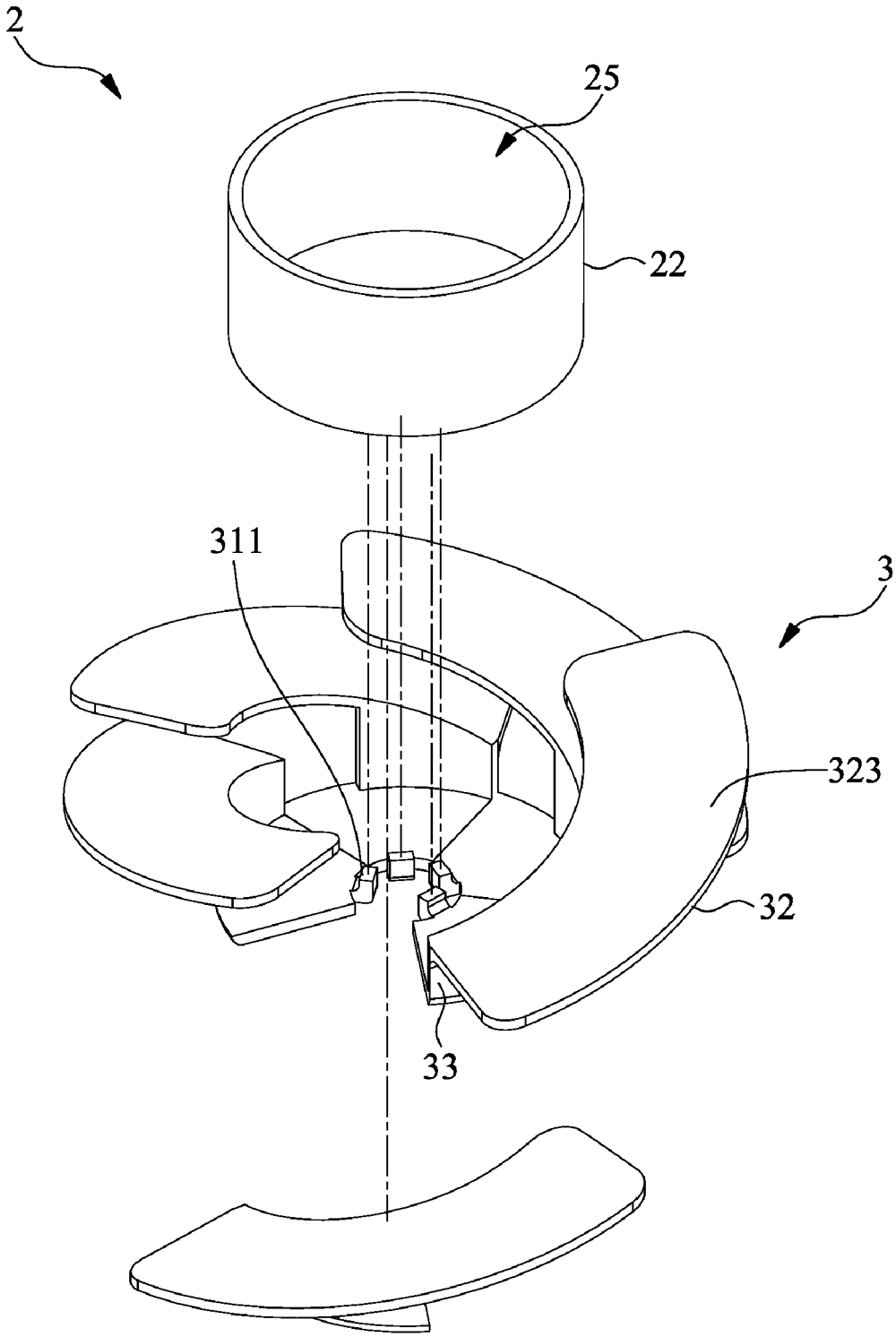
FIG. 5 is another perspective exploded view of the second aspect of the first embodiment of the present invention.
Figure 6:
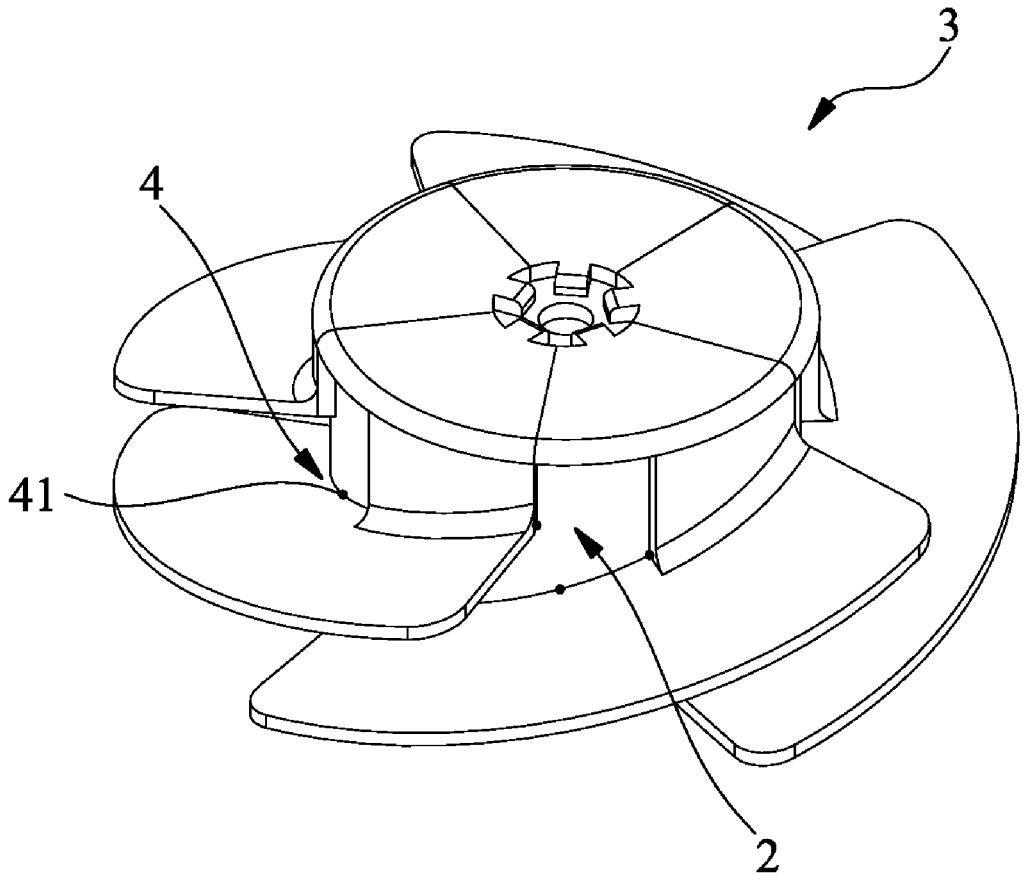
FIG. 6 is a perspective assembled view of the second aspect of the first embodiment of the present invention.
Figure 7:
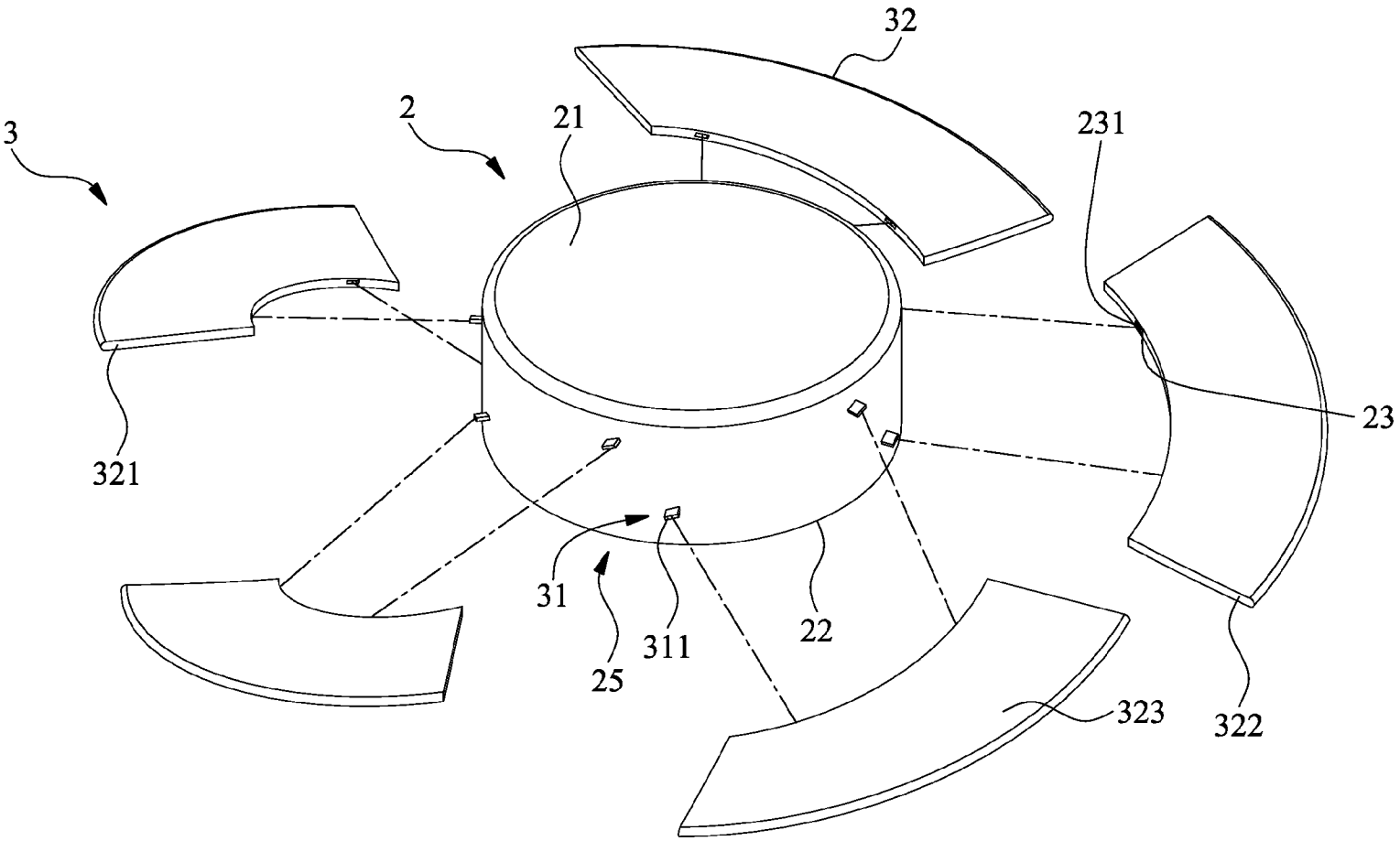
FIG. 7 is a perspective exploded view of a first aspect of a second embodiment of the present invention.
Figure 8:
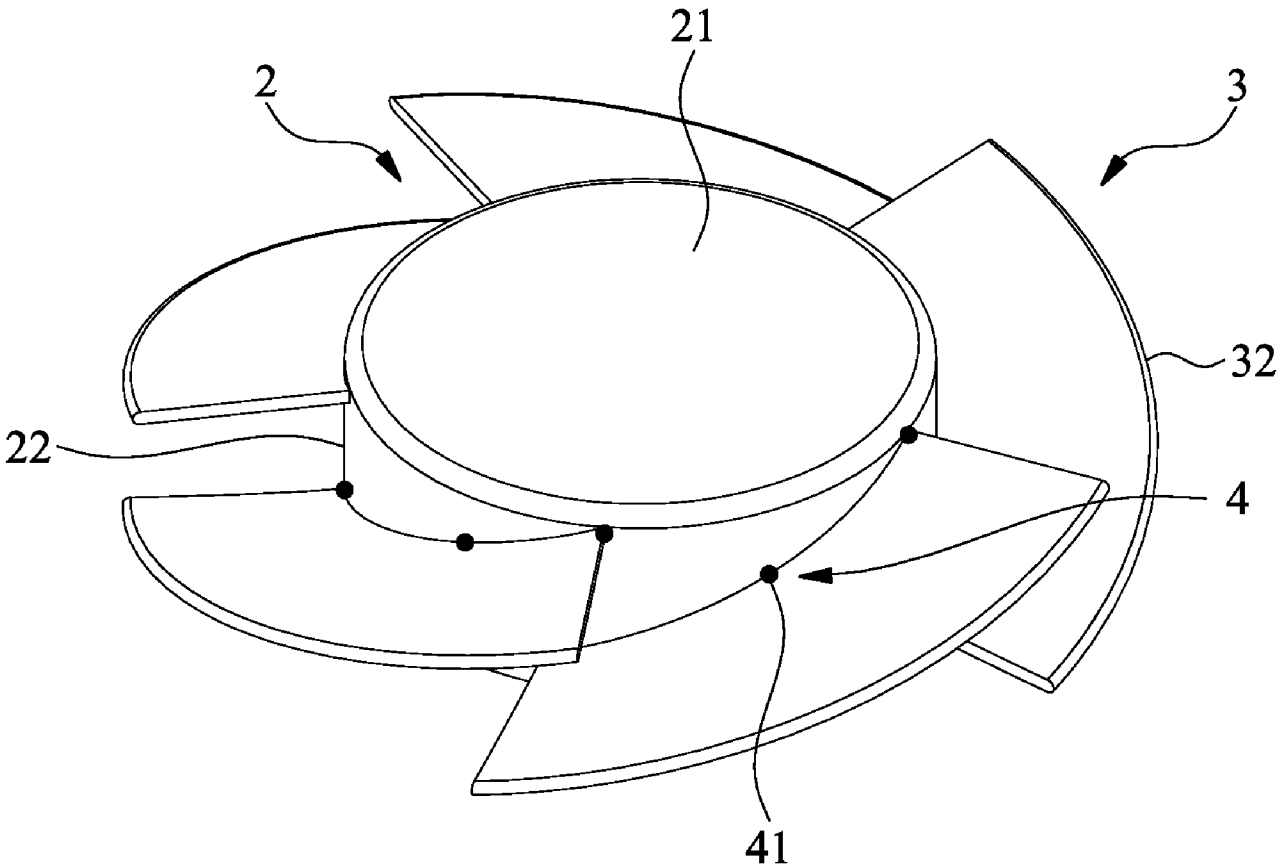
FIG. 8 is a perspective assembled view of the first aspect of the second embodiment of the present invention.
Figure 9:
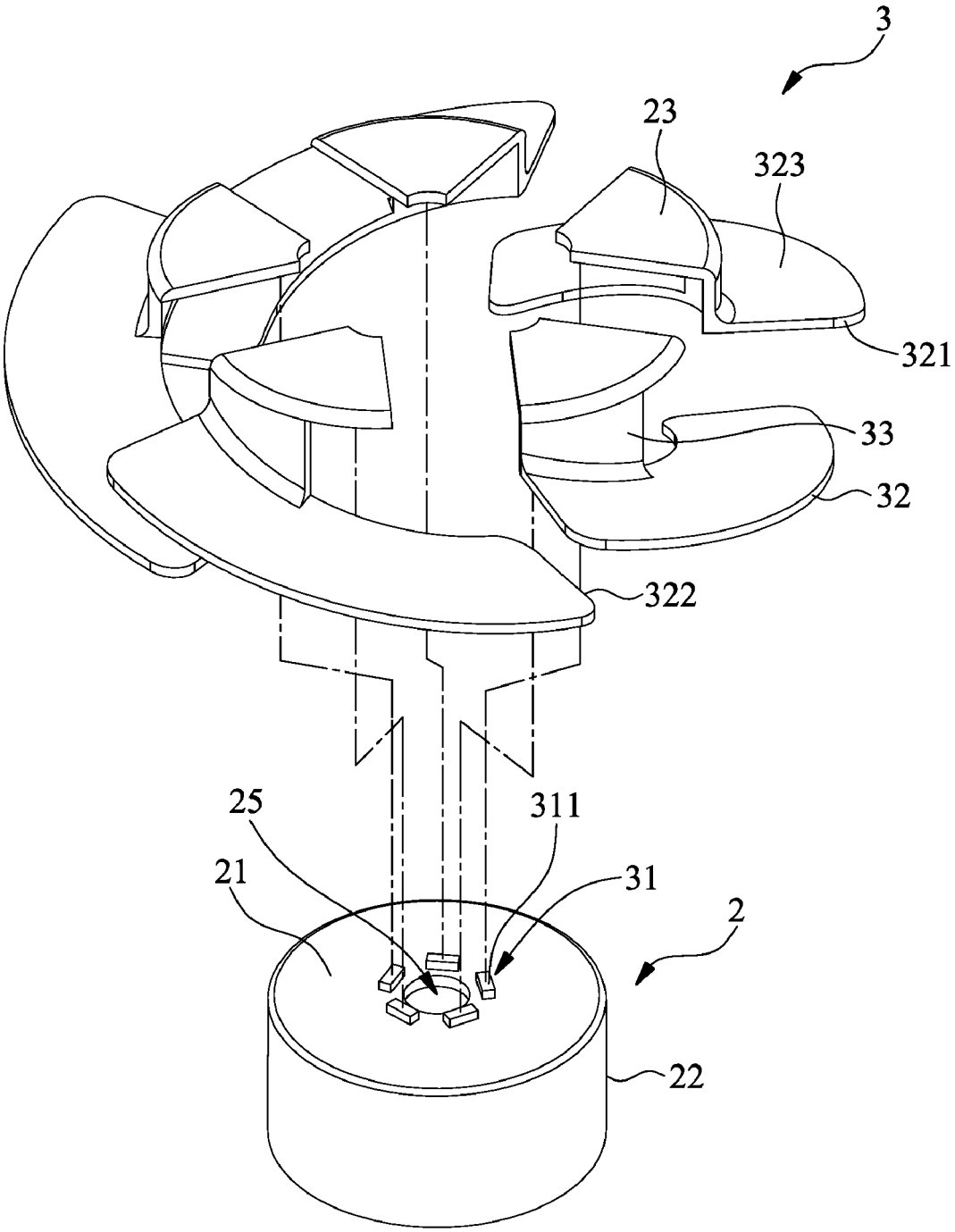
FIG. 9 is a perspective exploded view of a second aspect of the second embodiment of the present invention.
Figure 10:
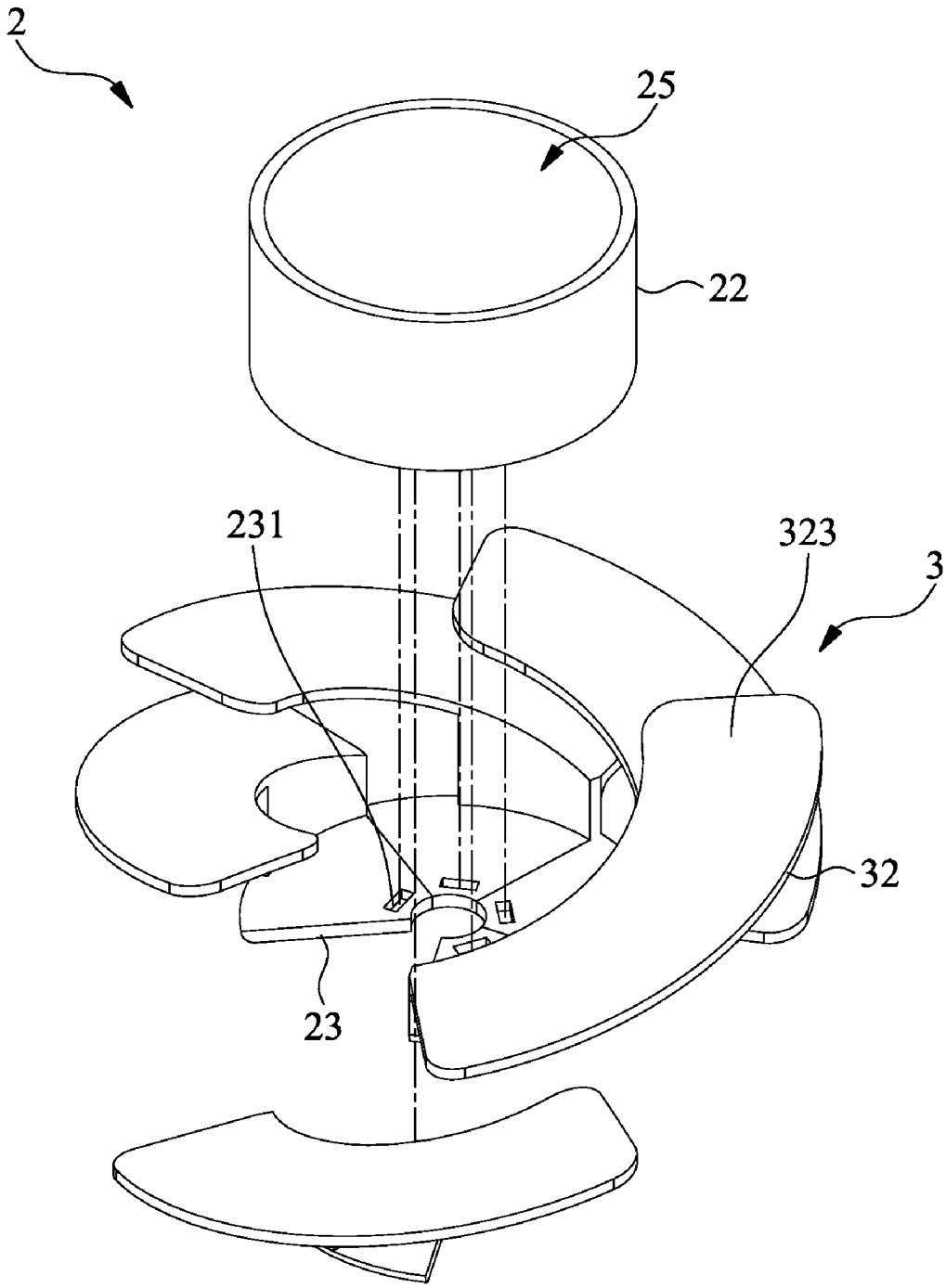
FIG. 10 is another perspective exploded view of the second aspect of the second embodiment of the present invention.
Figure 11:
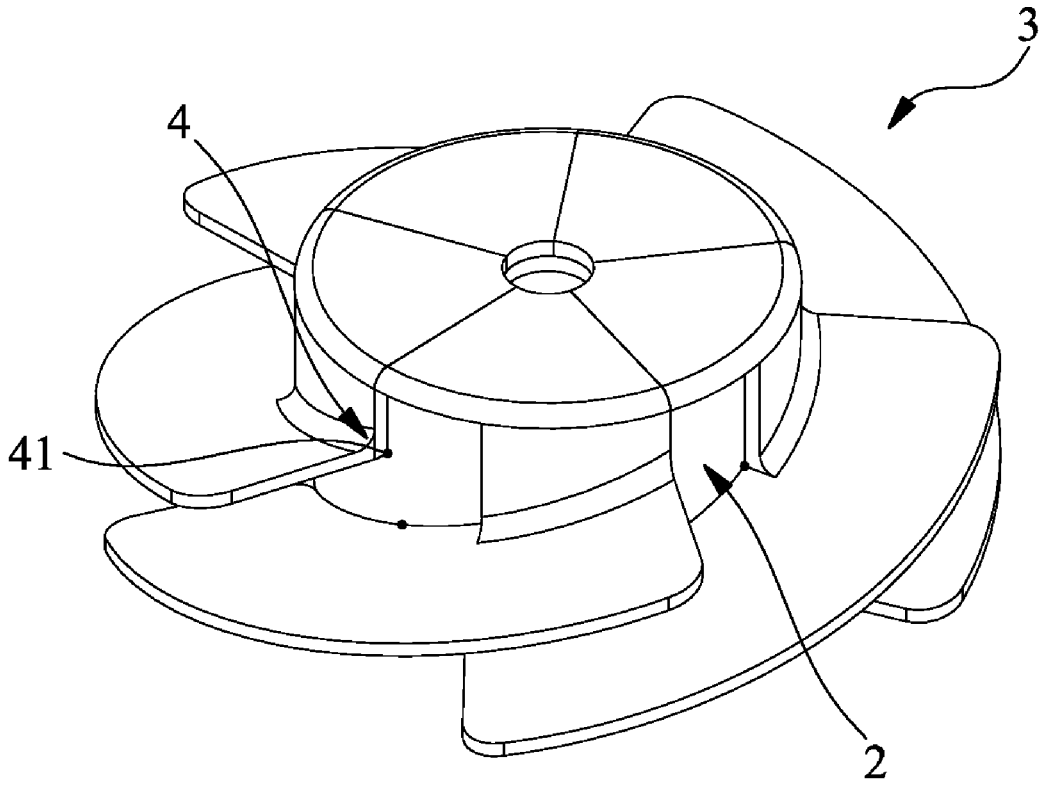
FIG. 11 is a perspective assembled view of the second aspect of the second embodiment of the present invention.

Please now refer to FIGS. 4, 5 and 6, which show the second aspect of this embodiment. The first connection sections 23 are annularly arranged on the top section 21 about a center thereof at equal intervals. The annular section 22 is perpendicularly connected with the circumference of the top section 21. That is, one end of the annular section 22 is connected with the circumference of the top section 21, whereby the annular section 22 and the top section 21 together define a receiving space 25 in which a shaft seat of a frame body (not shown) is enclosed. The hub 2 and the blades 3 are made of metal material such as iron, aluminum or copper or a metal alloy.

Each blade 3 has a wind guide section 32 and at least one second connection section 31. The second connection section 31 is disposed at one end of the blade 3. The second connection section 31 is complementary to the first connection section 23 and connected thereto, whereby the blade 3 is integrally connected with the hub 2. In other words, the second connection section 31 of the blade 3 is fixedly engaged with (or insert-connected with) the first connection section 23 of the annular section 22 to integrally connect the blade 3 with the hub 2. In addition, the blades 3 are positioned at different heights in an overlapping pattern. Under such circumstance, the fan can more efficiently operate to greatly enhance wind power. The second connection section 31 can be connected to the complementary first connection section 23 by way of engagement, insertion, tight fit or the like.

The wind guide section 32 has a front edge 321, a rear edge 322 and a wind guide face 323. One side of the wind guide face 323 between the front edge 321 and rear edge 322 is connected with the second connection section 31. The wind guide faces 323 of each two adjacent wind guide sections 32 are positioned at different heights in an overlapping pattern. The blade 3 further includes a support section 33 disposed between the wind guide section 32 and the second connection section 31 for supporting the wind guide section 32 and the second connection section 31. One end of the support section 33 is connected to the wind guide face 323, while the other end of the support section 33 is connected to one face of the second connection section 31. The wind guide section 32, the support section 33 and the second connection section 31 are integrally formed.

Please further refer to FIGS. 4, 5 and 6. The fan structure further includes a welding section 4 having at least one welding point 41 welded in a position near a conjunction between the first connection section 23 and the second connection section 31. To speak more specifically, after the first connection section 23 of the hub 2 is fixedly engaged with (or insert-connected with) the second connection section 31 of the blade 3, the second connection section 31 and the support section 33 are tightly attached to the top section 21 and the annular section 22 and one side of the wind guide face 323 of the wind guide section 32 is tightly attached to and leant against the circumference of the annular section 22. Then the welding point 41 of the welding section 4 is fixedly point-welded in the position near the conjunction between the first connection section 23 and the second connection section 31. The welding point 41 serves to enhance connection strength between the blade 3 and the hub 2.

The first connection section 23 has a locating hole 231 in communication with the receiving space 25. The second connection section 31 has a projection 311 outward extending from one end of the second connection section 31 corresponding to the locating hole 231. The projection 311 is fixedly inserted in the locating hole 231. That is, when assembled, the projection 311 of the second connection section 31 is fitted through the locating hole 231 of the first connection section 23 to protrude into the receiving space 25.

Accordingly, when connecting the blade 3 with the hub 2, the blade 3 is forced toward the hub 2 to fit the projection 311 of the second connection section 31 of the blade 3 into the locating hole 231 of the first connection section 23 and protrude the projection 311 into the receiving space 25. In this case, the projection 311 is fixedly engaged in the locating hole 231. At this time, the second connection section 31 and the support section 33 are tightly attached to the top section 21 and the annular section 22 and one side of the wind guide face 323 of the wind guide section 32 is snugly tightly attached to the circumference of the annular section 22. The wind guide faces 323 of the adjacent wind guide sections 32 are positioned in an overlapping pattern. Then the welding point 41 of the welding section 4 is fixedly welded in the position near the conjunction between the first connection section 23 and the second connection section 31. In addition, some welding points 41 of the other welding sections 4 are fixedly welded at the conjunctions between the support section 33, one side of the wind guide face 323, the top section 21 and the annular section 22 so as to enhance the connection strength between the blade 3 and the hub 2. In this case, the structural strength of the fan is enhanced as a whole and the wind power of the fan is greatly promoted.

The blades 3 are independently formed by means of pressing. In comparison with the complicated and difficult manufacturing process of the conventional blades, the blades 3 of the present invention are easier to manufacture so that the manufacturing cost is lowered.

Please now refer to FIGS. 7 to 11, which show another embodiment of the present invention. In this embodiment, the first connection sections 23 and the second connection sections 31 are exchanged. That is, the first connection sections 23 of the hub 2 are replaced with the second connection sections 31, while the second connection sections 31 of the blades 3 are replaced with the first connection sections 23.

According to the aforesaid, the fan structure of the present invention has the following advantages:

1. The manufacturing cost for the fan structure is lowered.
2. It is easier to manufacture the fan structure.
3. The wind power of the fan structure is increased.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan structure comprising:

a hub including a top section, an annular section and at least one first connection section, the at least one first connection section being disposed on the top section, one end of the annular section being connected with a circumference of the top section, whereby the annular section and the top section together define a receiving space, and the at least one first connection section has a locating hole in communication with the receiving space; and a plurality of blades having at least one second connection section, a wind guide section and a support section, the at least one second connection section disposed at one end of the blade and having a projection extending outward from one end for complementing the locating hole of the first connection section and connecting thereto, the blades being positioned in an overlapping pattern;

wherein each blade has a wind guide section, the wind guide section having a front edge, a rear edge and a wind guide face, one side of the wind guide face between the front edge and the rear edge being connected with the second connection section; and wherein the support section is disposed between the wind guide section and the second connection section, one end of the support section being connected to the wind guide face, while the other end of the support section is connected to one face of the second connection section.

2. The fan structure as claimed in claim 1, comprising a plurality of first connection sections annularly arranged on the top section about a center thereof at equal intervals.

3. The fan structure as claimed in claim 1, further comprising a welding section having at least one welding point, the welding point being welded in a position near a conjunction between the first connection section and the second connection section.

4. The fan structure as claimed in claim 1, wherein the hub and the blades are made of metal material.

* * * * *